US006145639A

United States Patent [19]

Roper

[11] Patent Number: 6,145,639

[45] Date of Patent: Nov. 14, 2000

[54] GUITAR STAND MUSIC BAG

[76] Inventor: Michael M. Roper, 1748 S. Delaware Pl., Tulsa, Okla. 74104

[21] Appl. No.: 09/253,159

[22] Filed: Feb. 19, 1999

[51] Int. Cl.[7] ..... A45C 13/00

[52] U.S. Cl. ..... 190/102; 206/314

[58] Field of Search ..... 383/38, 16, 39, 383/40, 86.2; 224/223, 426, 684, 463, 680, 682; 206/314, 478, 373; 190/102, 109, 110; 84/453; D3/204, 256, 319, 328, 11, 259, 254, 260, 216, 217

[56] References Cited

U.S. PATENT DOCUMENTS

| | | | |
|---|---|---|---|
| D. 281,290 | 11/1985 | Beigel | D3/256 |
| D. 340,131 | 10/1993 | Cassidy, IV | 190/102 X |
| 1,727,954 | 9/1929 | Beehler . | |
| 2,781,113 | 2/1957 | Seeman . | |
| 3,549,064 | 12/1970 | Wilson | 206/373 X |
| 4,114,667 | 9/1978 | Belson . | |
| 4,164,968 | 8/1979 | Esposito, Jr. et al. | 383/39 X |
| 4,301,898 | 11/1981 | Plough et al. . | |
| 4,334,612 | 6/1982 | Beato | 206/314 |
| 4,609,084 | 9/1986 | Thomas | 190/110 |
| 4,802,773 | 2/1989 | Gross | 383/16 |
| 4,917,160 | 4/1990 | Hart et al. | 190/109 X |
| 5,375,497 | 12/1994 | Pirchio et al. . | |
| 5,520,462 | 5/1996 | Clark . | |
| 5,567,055 | 10/1996 | Smith . | |
| 5,638,915 | 6/1997 | Hardy | 206/373 X |
| 5,779,036 | 7/1998 | Westbrook et al. | 190/102 X |

FOREIGN PATENT DOCUMENTS

| | | | |
|---|---|---|---|
| 621.586 | 5/1927 | France | 190/109 |
| 29 02 138 | 7/1980 | Germany | 190/102 |

*Primary Examiner*—Jes F. Pascua
*Attorney, Agent, or Firm*—Molly D. McKay

[57] ABSTRACT

A bag for carrying a guitar stand. The bag comprises a box shaped pouch having four walls, a bottom, an openable flap on top for a lid, and an interior compartment defined by the walls, bottom and lid. The flap and front wall of the pouch are provided with mating fasteners for securing the flap shut. The exterior surface of the front wall is provided with two loops, located on the lower portion of the wall approximately perpendicular to each other. The loops removably receive a folded down base of the guitar stand and a bar provided on the stand, respectively, in order to removably secure the stand to the outside of the bag. The bag is provided with a carrying strap by which the bag may be carried.

3 Claims, 3 Drawing Sheets

GUITAR STAND MUSIC BAG

BACKGROUND OF THE INVENTION

1. Field of the Invention

The present invention relates to a carrying bag for musicians and more specifically to a carrying bag with means provided on the exterior surface of the bag for securing a guitar stand on the outside of the bag.

2. Description of the Related Art

Musicians who play the guitar must carry their guitar stands with them whenever they travel with their instrument. Even when folded into its smallest configuration, a guitar stand is still long and odd shaped and is difficult to carry in conventional carry cases or bags. Also the stand is metal and has bars sticking out from it that make transporting the stand dangerous if the stand is not properly secured.

The present invention addresses these problems by providing a carrying bag to hold the musician's sheets of music and other items within the bag and also provides convenient loops strategically located on the exterior surface of the bag for securing a folded guitar stand to the outside of the bag.

SUMMARY OF THE INVENTION

The present invention is a musician's travel bag for carrying a guitar stand. The bag is preferably constructed of leather that is formed into a box shaped pouch having a bottom, four walls and a movable flap. The flap folds backward to open up the top of the bag, providing access to the interior of the bag. The flap also unfolds forward over the top of the bag, closing the bag and forming a lid for the compartment located within the pouch. The flap is of a sufficient length that, when the flap is closed, so that it forms a lid for the pouch, a distal end of the flap secures to the front wall of the pouch. Mating fastening means are provided on the distal end of the flap and on the front wall of the pouch. These mating fastening means cooperate in securing the flap shut on the pouch and allowing the flap to be opened.

The front wall of the pouch is provided with two loops that are oriented approximately at right angles to each other. The larger of the two loops is provided on the surface of the lower portion of one exterior side of the front wall. The smaller loop is provided on the surface of the lower portion of the opposite exterior side of the front wall. The larger loop is sufficiently large to removably receive the folded down base of a guitar stand. The smaller loop is sufficiently large to removably receive a bar provided perpendicular on the guitar stand that, when the guitar stand is in use, serves to hold the lower "Y" shaped guitar-receiving arm of the stand. The lower "Y" shaped guitar-receiving arm of the stand is removed from the stand and stored within the pouch for transport.

When the folded down base of the guitar stand is inserted into the first loop and the bar is inserted into the second loop, the upper "Y" shaped guitar receiving arm of the stand is then secured against one of the sidewalls of the pouch. The upper "Y" shaped guitar receiving arm is made secure relative to the base of the guitar stand by tightening the thumbscrew that is provided on the guitar stand for this purpose. When the upper "Y" shaped guitar receiving arm is made secure relative to the base, the upper arm is secured against the sidewall of the pouch by virtue of the base being secured to the pouch via the first loop. Once the guitar stand is thus secured to the pouch, it will remain tightly attached to the pouch under the influence of gravity until the user removes it from the loops.

In order to more securely hold the stand, it may be desirable to tilt the first loop slightly upward on the end of the first loop that is adjacent to the second loop. The upward tilt of the loop will cause the heavier base end of the stand to be retained in the first loop under the influence of gravity. The second loop serves to hold the upper end of the stand above the first loop, thereby encouraging the base end to remain in the first loop. The second loop also serves to prevent the stand from rotating within the first loop, thus forcing the upper "Y" shaped guitar receiving arm of the stand to remain secured against the side wall of the pouch. A carrying strap is secured to the bag as a means for carrying the bag.

DETAILED DESCRIPTION OF THE PREFERRED EMBODIMENT

INVENTION

Figure 1:
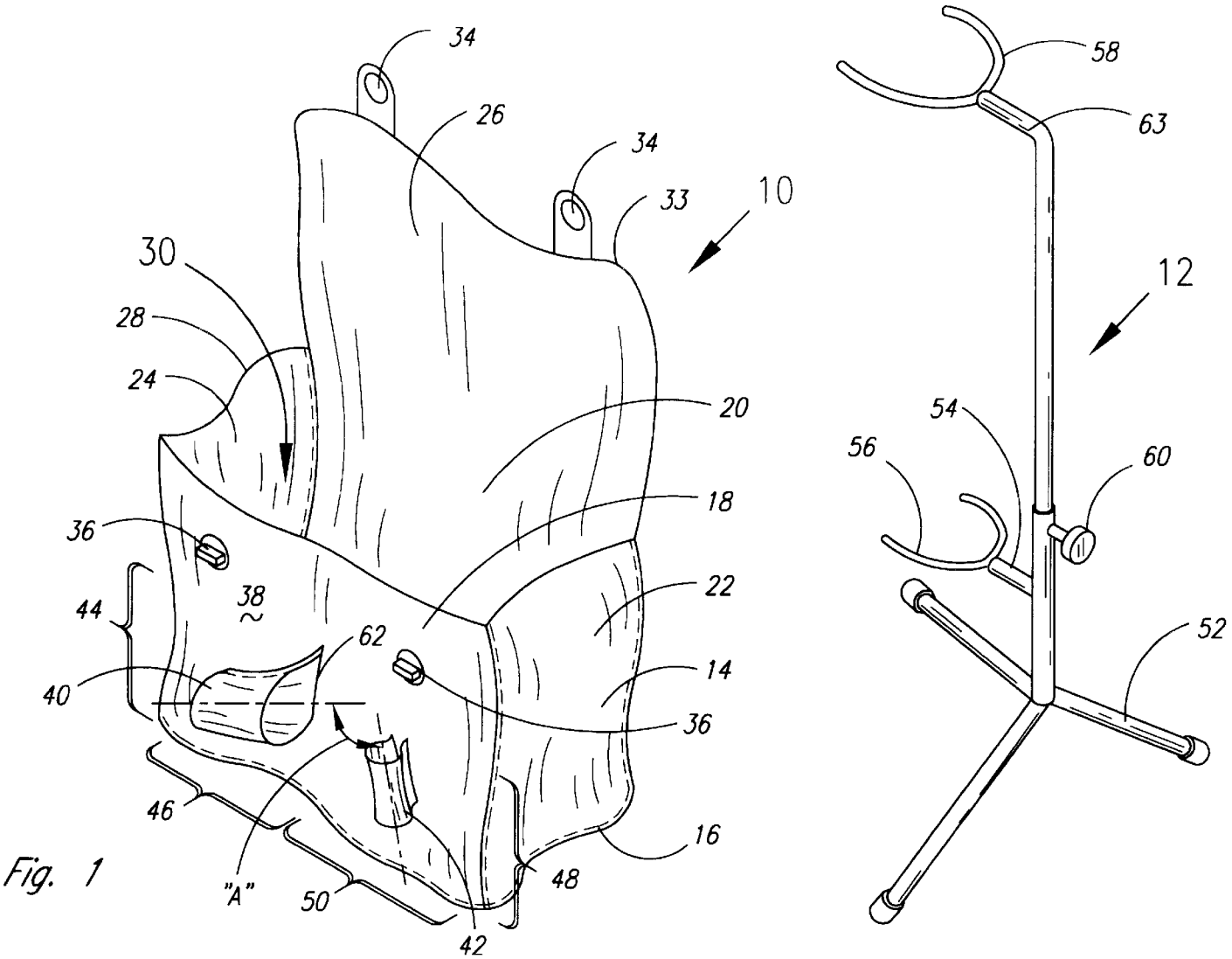
FIG. 1 is a perspective view of a preferred embodiment of the present invention and a guitar stand, as it would appear when in use.
Figure 2:
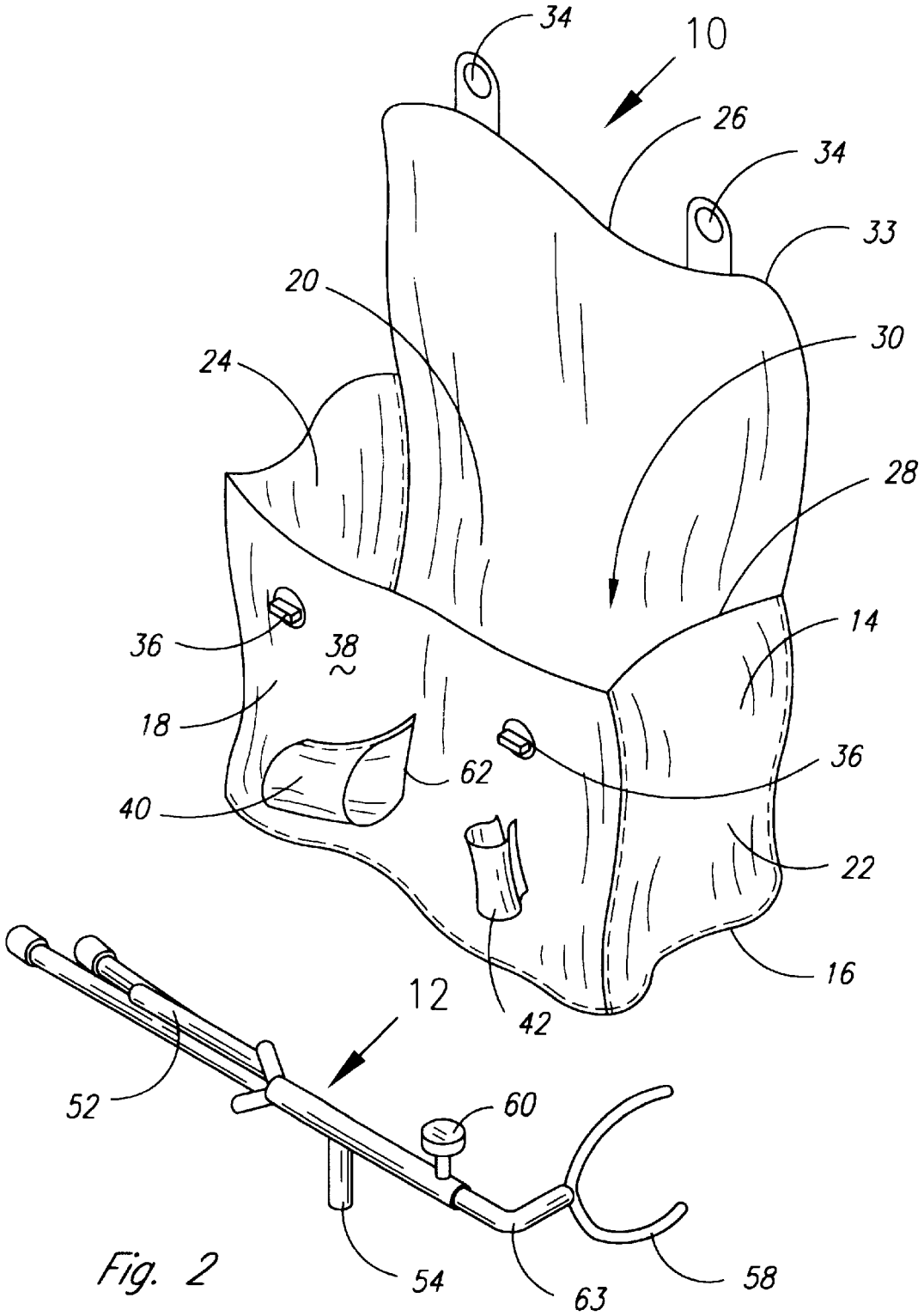
FIG. 2 is a perspective view of the invention and the guitar stand of FIG. 1, with the guitar stand folded down for transport.

Referring now to the drawings, and initially to FIG. 1, there is illustrated a guitar stand music bag 10 and a guitar stand 12. The guitar stand music bag 10 that is illustrated in FIG. 1 is constructed in accordance with a preferred embodiment of the present invention, and the guitar stand of FIG. 1 is show in its fully extended, in use position. The invention is a travel bag 10 for carrying the guitar stand 12.

The bag 10 is preferably constructed of leather that is formed into a box shaped pouch 14, comprised of a bottom 16, a front wall 18, a back wall 20, two side walls 22 and 24, and a movable flap 26. The flap 26 can be folded backward to open up the top 28 of the bag 10, thereby providing access to an interior compartment 30 provided within the bag 10. The flap 26 also can be unfolded forward over the top 28 of the bag 10, closing the bag 10 and forming a lid 32 for the interior compartment 30 of the bag 10.

The flap 26 is of a sufficient length that, when the flap 26 is closed and forms the lid 32 for the pouch 14, a distal end 33 of the flap 26 secures to the front wall 18 of the pouch 14. Mating fasteners 34 and 36 are provided, respectively, on the distal end 33 of the flap 26 and on an exterior surface 38 of the front wall 18 of the pouch 14. These mating fastenings 34 and 36 cooperate to secure the flap 26 shut on the pouch 14 and also can be disengaged from each other to allow the flap 26 to be opened.

The exterior surface 38 of the front wall 18 of the pouch 14 is provided with two loops 40 and 42. The loops 40 and 42 are oriented approximately at a right angle to each other, as illustrated by the angle "A" shown in FIG. 1. The larger first loop 40 of the two loops 40 and 42 is provided on the exterior surface 38 on a lower portion 44 of one side 46 of the front wall 18. The smaller second loop 42 is provided on the exterior surface 38 on a lower portion 48 of the opposite side 50 of the front wall 18. The larger loop 40 is sufficiently large to removably receive the folded down base 52 of the guitar stand 12, and the smaller loop 42 is sufficiently large to removably receive a bar 54 provided perpendicular on the guitar stand 12. The function of this bar 54 is to hold the lower "Y" shaped guitar receiving arm 56 provided on the guitar stand 12 when the guitar stand 12 is in use, as illustrated in FIG. 1. The lower "Y" shaped guitar-receiving arm 56 is removable from the stand 12 and is removed from the stand 12 and stored within the interior compartment 30 of the pouch 14 for transport.

When the folded down base 52 of the guitar stand 12 is inserted into the first loop 40 and the bar 54 is inserted into the second loop 42, the stand 12 is then shortened by adjusting an upper "Y" shaped guitar receiving arm 58 provided on the stand 12 so that it rests against a side wall 22 of the pouch. The upper "Y" shaped guitar receiving arm 58 is made secure relative to the base 52 of the guitar stand 12 by tightening a thumb screw 60 that is provided on the guitar stand 12. The thumbscrew 60 allows the upper "Y" shaped guitar-receiving arm 58 to be non-permanently secured at various positions relative to the base 52. Thus, the thumb screw 60 enables the guitar stand 12 to be adjusted in height by allowing the upper "Y" shaped guitar receiving arm 58 to be telescoped upward and downward relative to the base 52. After the base 52 is secured in the first loop 40 and the bar 54 is secured in the second loop 42, the thumb screw 60 is first loosened, the upper "Y" shaped guitar receiving arm 58 is moved toward the base 52 until the arm 58 abuts the side wall 22, and then the thumb screw 60 is retightened to secure the arm 58 against the side wall 22. The arm 58 will remain secured to the sidewall 22 until the stand 12 is removed from one or more of the loops 40 and 42. Once the guitar stand 12 is thus secured to the bag 10, it will remain tightly attached to the bag 10 under the influence of gravity until it is removed from the loops 40 and 42.

In order to more securely hold the stand 12 within the loops 40 and 42, it may be desirable to tilt the first loop 40 slightly upward on an end 62 of the first loop 40 that is adjacent to the second loop 42. Tilting the first loop 40 upward in this manner will cause the heavier base 52 of the stand 12 to be retained more securely in the first loop 40 under the influence of gravity. The second loop 42 serves to hold an upper end 63 of the stand 12 above the first loop 40, thereby encouraging the base 52 to remain in the first loop 40. The second loop 42 also serves to prevent the stand 12 from rotating within the first loop 40, thus forcing the upper "Y" shaped guitar receiving arm 58 of the stand 12 to remain secured against the side wall 22 of the pouch 14.

Figure 3:
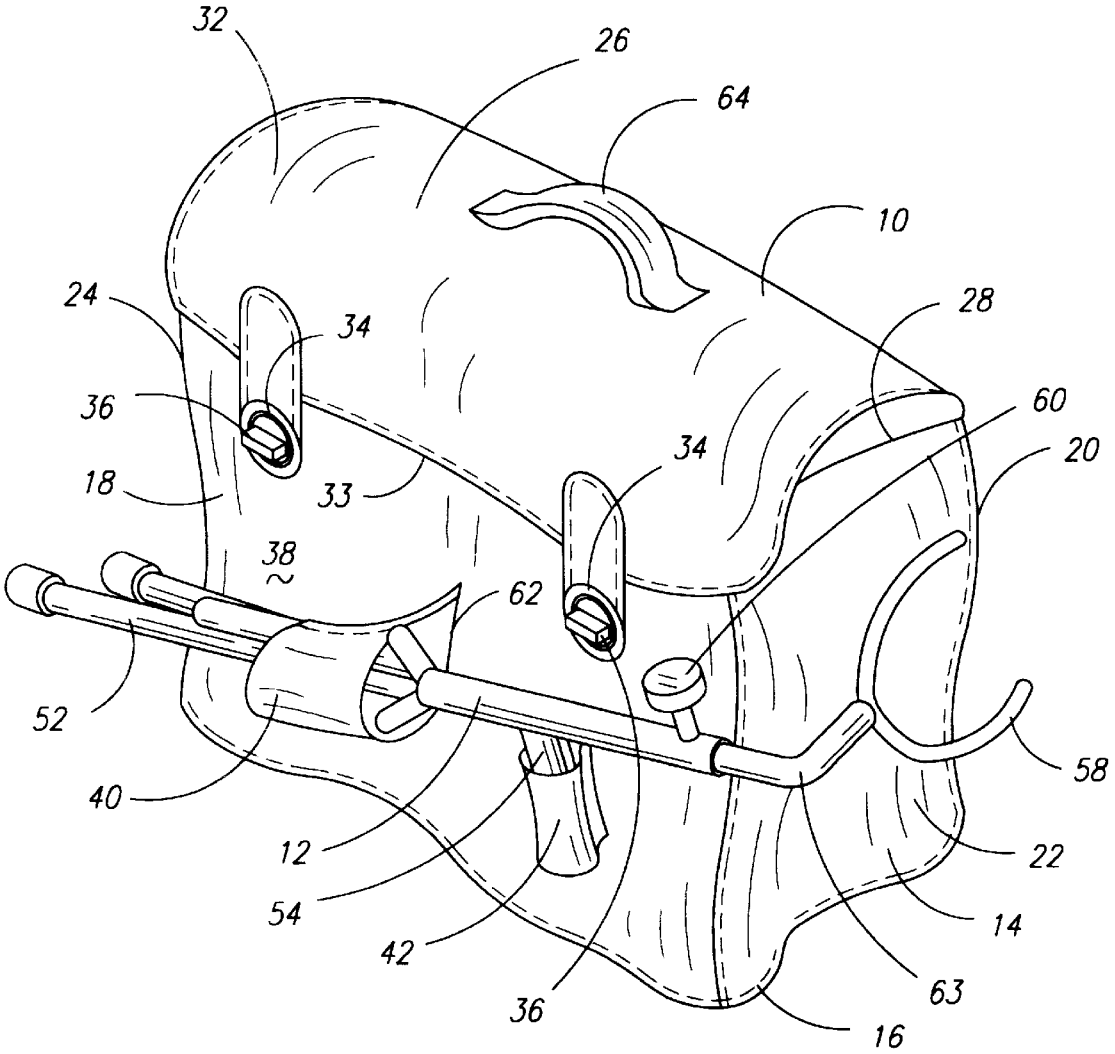
FIG. 3 is a perspective view of the invention if FIG. 2, shown with the folded down guitar stand attached to the invention.

As illustrated in FIG. 3, the bag 10 is provided with a carrying strap 64 secured to it as a means of carrying the bag 10. Although a short handle type of carrying strap 10 is illustrated, longer types of carrying straps 10 may optionally be provided on the bag 10.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A guitar stand music bag and telescoping guitar stand with fold down tripod base comprising a pouch having a bottom and four walls, an openable flap secured to one of said walls so that the pouch and flap define an interior compartment, a carrying strap secured to said pouch for carrying said pouch, a first loop and a second loop secured to an exterior surface of one of said walls so that said loops are approximately perpendicular to each other, said first loop removably receiving a folded down base of a telescoping guitar stand having a fold down tripod base and said second loop removably receiving a bar provided on said guitar stand.

2. A bag according to claim 1 wherein said first loop is tilted upward on an end of the first loop adjacent to the second loop.

3. A bag according to claim 2 further comprising a fastener provided on a distal end of said flap and a mating fastener provided on one of said as a means to secure the flap over the pouch.

* * * * *